US008777211B2

(12) United States Patent
Lo

(10) Patent No.: US 8,777,211 B2
(45) Date of Patent: Jul. 15, 2014

(54) PAPER OUTPUT MECHANISM

(71) Applicant: Hon Hai Precision Industry Co., Ltd., New Taipei (TW)

(72) Inventor: Wen-Chung Lo, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/892,520

(22) Filed: May 13, 2013

(65) Prior Publication Data

US 2014/0027973 A1 Jan. 30, 2014

(30) Foreign Application Priority Data

Jul. 24, 2012 (TW) ..... 101126547 A

(51) Int. Cl.
*B65H 3/04* (2006.01)

(52) U.S. Cl.
USPC ..... 271/34; 271/18

(58) Field of Classification Search
USPC ..... 271/34, 10.06, 117, 18, 18.1, 18.2, 94, 271/95, 126, 127
See application file for complete search history.

(56) References Cited

U.S. PATENT DOCUMENTS

| | | | | |
|---|---|---|---|---|
| 5,947,466 | A * | 9/1999 | Romine | 271/34 |
| 8,408,532 | B2 * | 4/2013 | Higaki et al. | 271/18.1 |
| 2012/0061904 | A1 * | 3/2012 | Higaki et al. | 271/34 |

* cited by examiner

*Primary Examiner* — Jeremy R Severson
(74) *Attorney, Agent, or Firm* — Novak Druce Connolly Bove + Quigg LLP

(57) ABSTRACT

A paper outputting mechanism includes a paper tray for receiving a paper, a paper drive device located above the paper tray, and a paper outputting device engaged with the paper drive device. The paper outputting device includes a drive wheel and a belt surrounding the drive wheel. The belt includes a touching portion. The paper outputting device is moveable by the paper pickup arm, so that the touching portion completely abuts the paper.

16 Claims, 6 Drawing Sheets

PAPER OUTPUT MECHANISM

BACKGROUND

1. Technical Field

The present disclosure relates to image forming devices, more particularly, to a paper output mechanism.

2. Description of Related Art

In general, an image forming device, such as a printer, a scanner, or a copier, includes a paper output unit which outputs sheets of paper. However, it is difficult to output thick and heavy paper from the paper output unit. Therefore, there is room in the art for improvement.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
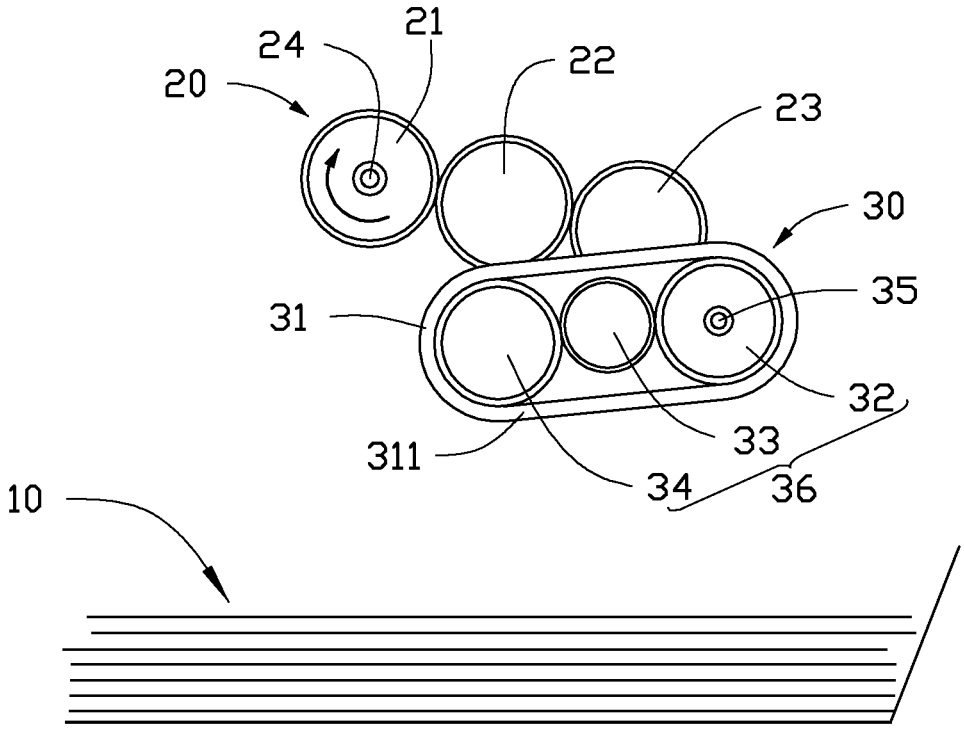
FIG. 1 is an isometric view of a paper output mechanism in accordance with an embodiment.
Figure 4:
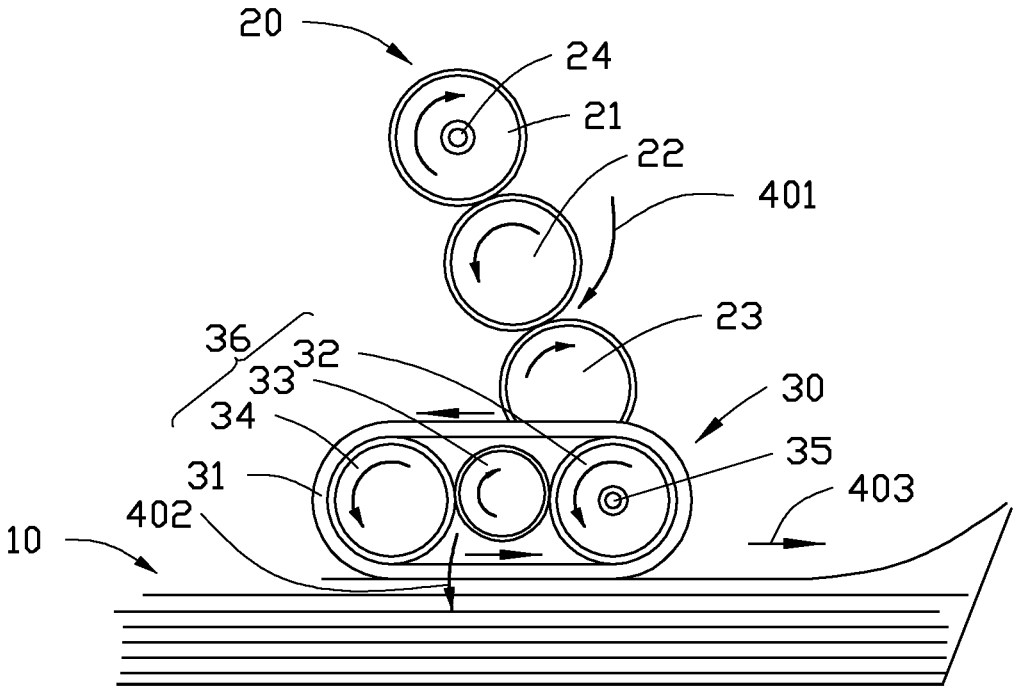
FIG. 4 is a similar to FIG. 3, but shows the paper outputting mechanism in a second position.

FIGS. 1 and 4 show a paper outputting mechanism in accordance with an embodiment. The paper outputting mechanism comprises a paper tray 10, a paper drive device 20 above the paper tray 10, and a paper outputting device 30 located on the paper drive device 20. The paper tray 10 receives paper. The paper outputting device 30 can be moved along the paper drive device 20. In one embodiment, the paper outputting mechanism can be used as a part of a scanner, a printer, or a copier, for example.

The paper arm 20 comprises a drive gear 21, an intermediate gear 22, and a slave gear 23. The intermediate gear 22 is positioned between and meshes with the drive gear 21 and the slave gear 23. The drive gear 21 can be rotated about a first rotating shaft 24 that is substantially parallel to the horizontal plane. The intermediate gear 22 is rotated by the drive gear 21 and rotates the slave gear 23 when the drive gear 21 is rotated.

The outputting device 30 comprises a belt 31 and a rotating arm 36. The rotating arm comprises a drive wheel 32, a slave wheel 34, and an idler wheel 33 meshing with the drive wheel 32 and the slave wheel 34. When the drive wheel 32 is rotated by the slave gear 23, the idler wheel 33 is rotated by the drive wheel 32, and the slave wheel 34 is rotated by the belt 31

The belt 31 surrounds the drive wheel 32 and the slave wheel 34, and the belt 31 can be moved with the drive wheel 32. The belt 31 comprises a touching portion 311 with a touching surface, which abuts the paper of the paper tray 10. The slave wheel 32 is rotated about the second rotating shaft 35, which is substantially parallel to the first rotating shaft 24. The rotating arm 36 can be rotated about the second rotating shaft 35 toward or away from the paper tray 10. The drive wheel 32 is engaged with the slave gear 23 by a shaft (not shown). When the slave gear 23 moves the drive wheel 32, a first direction 401 of the slave gear 23 is opposite to a second direction 402 of the drive wheel 32.

Figure 3:
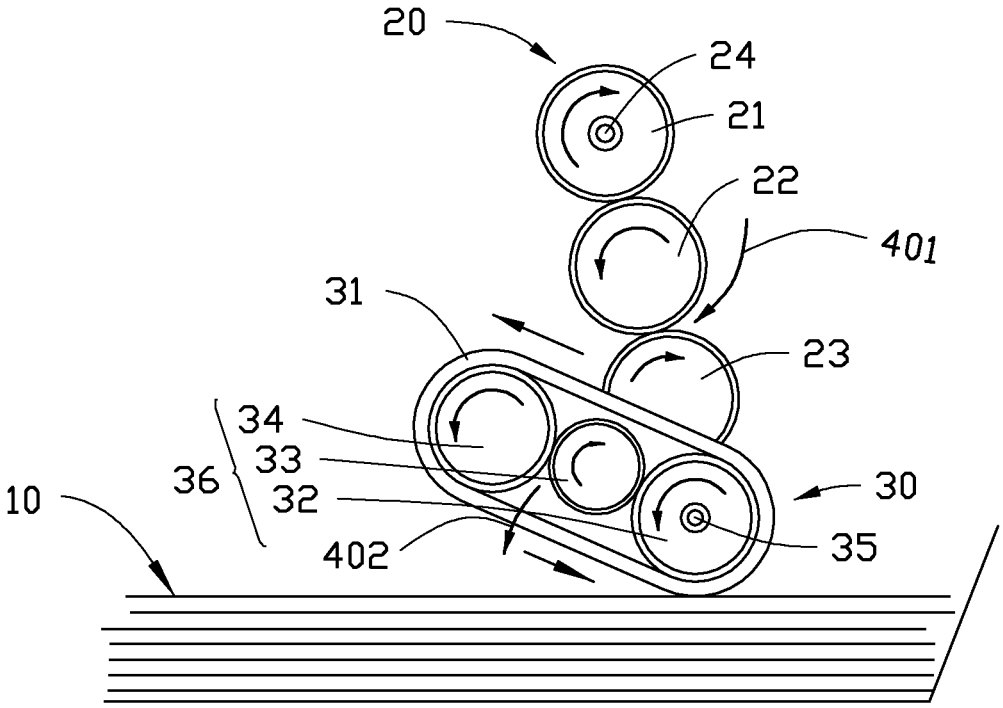
FIG. 3 is similar to FIG. 1, and shows the paper outputting mechanism in a first position.

FIGS. 3 and 4 show that the paper outputting device 30 can be located between a first position (see FIG. 3) and a second position (see FIG. 4). In the first position, a first end of the touching portion 311 abuts the papers of the paper tray 10, and a second end of the touching portion 311 is away from the paper of the paper tray 10. In the second position, the first end of the touching portion 311 and the second end of the touching portion 311 together abut the papers of the paper tray 10, so the touching surface of the touching portion 311 completely abuts the paper of the paper tray 10.

Figure 2:
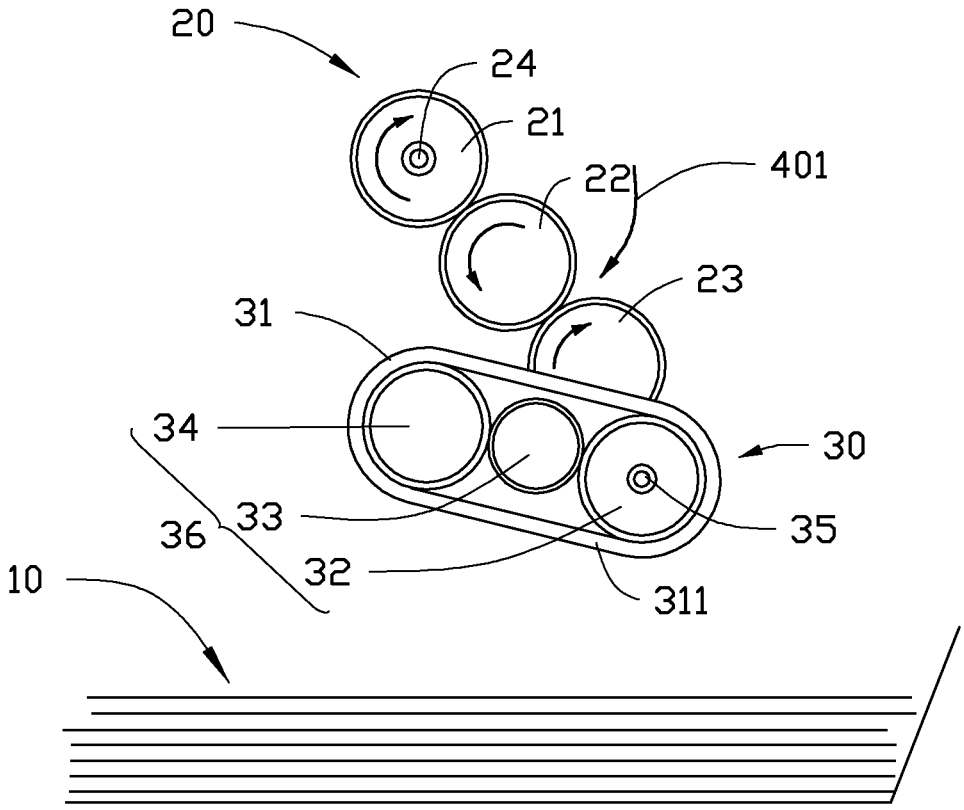
FIG. 2 is similar to FIG. 1, but viewed from a different aspect.

FIGS. 2-4 show that in use, the drive gear 21 is rotated about the first rotating shaft 24 in the first direction 401. The intermediate gear 22 is rotated in a counterclockwise (the second direction 402) by the drive gear 21 to rotate the slave gear 23 in the first direction 401. Simultaneously, the drive wheel 32 is rotated about the second rotating shaft 35 in the second direction 402. Thus, the idle wheel 33 is rotated by the drive wheel 32 in the first direction 401. The slave wheel 34 is rotated by the belt 31 in the second direction 402.

FIG. 3 shows that until a first end of the touching portion 311 abuts the paper in the paper tray 10, the paper drive device 20 is stopped. The paper outputting device 30 continues to operate, the drive wheel 32 rotates the belt 31 which is counterclockwise. Therefore, a first frictional force is generated between the touching portion 311 and the paper of the paper tray 10. When a first paper of the paper tray is light and thin, the first paper of the paper tray 10 is moved towards a third direction 403.

FIGS. 3 and 4, if a second paper of the paper tray 10 is heavy and thick, a second frictional force greater than the first frictional force must be generated between the touching portion 311 and the second paper of the paper tray 10. When the drive wheel 32 is rotated about the second rotating shaft 35, the rotating arm 36 is also rotated about the rotating shaft 35 towards the paper tray 10 in the second direction, until a second end of the touching portion 311 abuts the paper of the paper tray 10. The second frictional force is greater than the first frictional force, is generated between the touching portion 311 and the second paper of the paper tray. Therefore, the second paper of the paper tray 10 is moved towards the right (a third direction 403).

Figure 5:
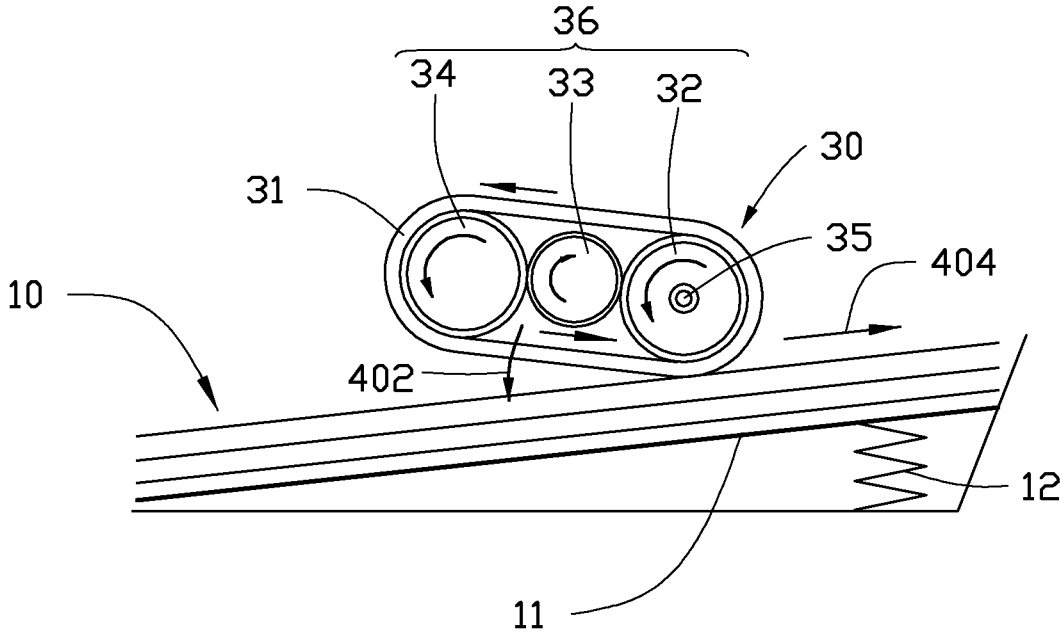
FIG. 5 is an isometric view of the paper outputting mechanism in accordance with an another embodiment.
Figure 6:
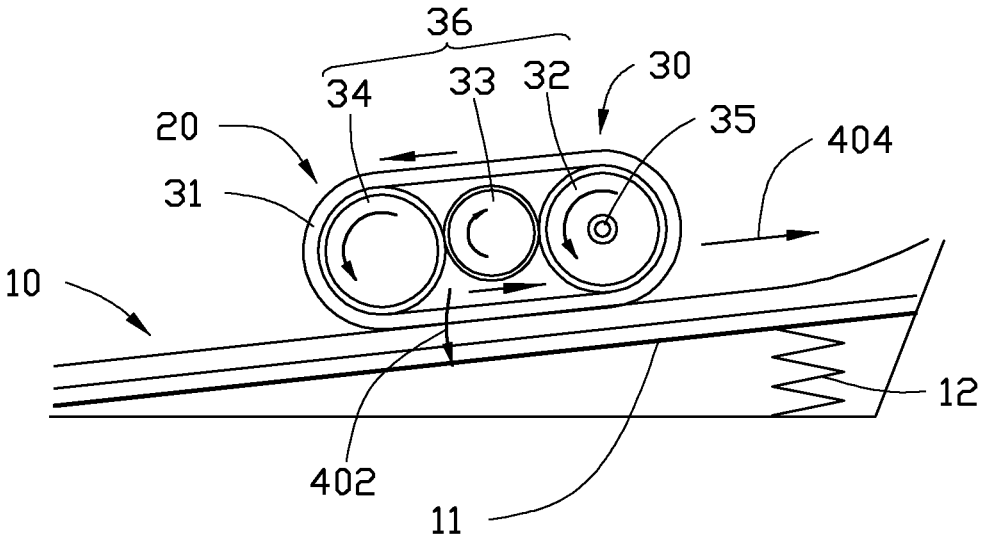
FIG. 6 is similar to FIG. 5, but viewed from a different aspect.

FIGS. 5 and 6 show a paper outputting mechanism in accordance with another embodiment. In one embodiment, the paper tray 10 is moveable upwards or downwards. The paper tray 10 comprises a supporting plate 11 and a lifting device 12. The paper is received in the supporting plate 11, and the lifting device 12 can adjust an angle between the supporting plate 11 and the level plane. The supporting plate 11 is adjusted by the lifting device 10 to abut the belt 31. In one embodiment, the lifting device 12 can be a spring, which is moved upwards or downwards.

In use, the drive wheel 32 is rotated about the second rotating shaft 35 in the second direction 402. The idle wheel 34 is rotated by the drive wheel 32 in the first direction 401, to rotate the slave wheel 34 in the second direction 402. The supporting plate 11 moves upwards by the lift device 12, until the first end of the touching portion 311 abuts the paper of the paper tray 10. When the first paper of the paper tray 10 is light and thin, the first paper is moved in a forth direction 404.

If the second paper of the paper tray 10 is heavy and thick, a second frictional force greater than the first frictional force, must be generated between the touching portion 311 and the second paper of the paper tray. When the drive wheel 32 is rotated about the second rotating shaft 35, the rotating arm 36 is also rotated about the rotating shaft 35 towards the paper tray 10 in the second direction. The supporting plate 11 moves upwards by the lifting device 12, until the second end of the belt 31 abuts the paper of the paper tray 10. The second frictional force greater than the first frictional force, is generated between the touching portion 311 and the second paper of the paper tray 10, gripped by the belt 31. Therefore, the second paper of the paper tray 10 is moved in the forth direction 404.

It is to be understood, however, that even though numerous characteristics and advantages have been set forth in the foregoing description of embodiments, together with details of the structures and functions of the embodiments, the disclosure is illustrative only and changes may be made in detail, especially in the matters of shape, size, and arrangement of parts within the principles of the disclosure to the full extent indicated by the broad general meaning of the terms in which the appended claims are expressed.

What is claimed is:

1. A paper outputting mechanism comprising:

a paper tray configured for receiving paper;

a paper drive device located above the paper tray; and a paper outputting device comprising an idle wheel, a drive wheel, a slave wheel, and a belt surrounding the drive wheel and the slave wheel; the idle wheel meshing with the drive wheel and the slave wheel;

wherein the paper outputting device is operated by the paper drive device, the belt abuts the paper, and the outputting device is engaged with the drive wheel of the paper drive device.

2. The paper outputting mechanism of claim 1, further comprising a first rotating shaft and a second rotating shaft substantially parallel to the first rotating shaft, wherein the paper drive device is rotatable about the first rotating shaft, and the paper outputting device is rotatable about the second rotating shaft.

3. The paper outputting mechanism of claim 1, wherein a rotating arm is defined by the drive wheel, the idle wheel, and the slave wheel, and the rotating arm is rotatable about the second rotating shaft.

4. The paper outputting mechanism of claim 1, wherein the drive wheel and the slave wheel is rotatable in a first direction, and the idle wheel is rotatable in a second direction opposite to the first direction.

5. The paper outputting mechanism of claim 4, wherein the paper drive device further comprises a slave gear meshing with the drive wheel, and the slave gear is rotatable in the second direction.

6. The paper outputting mechanism of claim 5, wherein the paper drive device further comprises a drive gear and an intermediate gear, and the intermediate gear meshes with the drive gear and the slave gear.

7. The paper outputting mechanism of claim 5, wherein the paper outputting device is moveable between a first position and a second position; in the first position, a first end of the touching portion abuts the paper; in the second position, a second end of the touching portion and the first end of the touching portion abut the paper.

8. A paper outputting mechanism comprising:

a paper tray comprising a supporting plate and a lifting device engaged with the supporting plate, and a paper outputting device comprising an idle wheel, a slave wheel, a drive wheel and a belt surrounding the drive wheel, the belt comprising a touching portion, the paper outputting device engaged with the drive wheel of the paper drive device; the idle wheel meshing with the drive wheel and the slave wheel;

wherein a position of the supporting plate is adjustable by the lifting device, so that the paper outputting device is moveable between a first position and a second position; in the first position, a first end of the touching portion abuts the paper; in the second position, a second end of the touching portion and the first end of the touching portion together abut the paper.

9. The paper outputting mechanism of claim 8, further comprising a rotating shaft defined in the drive wheel, wherein a rotating arm is defined by the drive wheel, the idle wheel, and the slave wheel, and the rotating arm is rotatable about the rotating shaft.

10. The paper outputting mechanism of claim 8, wherein the drive wheel and the slave wheel is rotatable in a first direction, and the idle wheel is rotatable in a second direction opposite to the first direction.

11. The paper outputting mechanism of claim 8, wherein the lifting device is a spring.

12. A paper outputting mechanism comprising a paper tray and a paper outputting device, wherein the paper tray comprises a supporting plate and a lifting device engaged with the supporting plate; the paper outputting device is engaged with the paper drive device; the paper outputting device comprises an idle wheel, a slave wheel, a drive wheel and a belt surrounding on the drive wheel; the idle wheel meshes with the drive wheel and the slave wheel; the supporting plate is adjustable by the lifting device, so that the paper outputting device is moveable between a first position and a second position; in the first position, the belt line contacts with a paper of supporting plate; in the second position, the belt surface contacts with the paper of the supporting plate.

13. The paper outputting mechanism of claim 12, wherein the belt comprises a touching portion; when the paper outputting device is located in the first position, a first end of the touching portion abuts the paper; when the paper outputting device is located in the second position, a second end of the touching portion and the first end of the touching portion together abut the paper.

14. The paper outputting mechanism of claim 12, further comprising a rotating shaft defined in the drive wheel, wherein a rotating arm is defined by the drive wheel, the idle wheel, and the slave wheel, and the rotating arm is rotatable about the rotating shaft.

15. The paper outputting mechanism of claim 14, wherein the drive wheel and the slave wheel is rotatable in a first direction, and the idle wheel is rotatable in a second direction opposite to the first direction.

16. The paper outputting mechanism of claim 12, wherein the lifting device is a spring.

* * * * *